US009530595B2

(12) United States Patent
Benke et al.

(10) Patent No.: US 9,530,595 B2
(45) Date of Patent: Dec. 27, 2016

(54) CIRCUIT BREAKER WITH LOW-CLEARANCE CONNECTIONS

(71) Applicant: Eaton Corporation, Cleveland, OH (US)

(72) Inventors: James Jeffery Benke, Pittsburgh, PA (US); Daniel Evan Palmieri, Coraopolis, PA (US); Zachary Ryan Jenkins, Pittsburgh, PA (US); Matthew Eugene Siegfried, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 14/087,661

(22) Filed: Nov. 22, 2013

(65) Prior Publication Data

US 2015/0144597 A1 May 28, 2015

(51) Int. Cl.

| | |
|---|---|
| ***H01H 33/66*** | (2006.01) |
| ***H01H 33/662*** | (2006.01) |
| ***H01H 33/666*** | (2006.01) |
| ***H01R 9/26*** | (2006.01) |

(52) U.S. Cl.

CPC ..... *H01H 33/662* (2013.01); *H01H 33/66* (2013.01); *H01H 33/6661* (2013.01); *H01R 9/26* (2013.01)

(58) Field of Classification Search

CPC .. H01H 33/66; H01H 33/6661; H01H 1/5833; H01H 2009/526; H01H 2033/6623; H01H 2033/6665; H01H 33/027; H01H 33/127; H01H 33/24; H01H 33/6606; H01H 33/662; H01H 37/767; H01H 3/0213; H01H 3/48; H02B 1/015

USPC ..... 200/400; 218/12, 118, 120, 136, 139, 218/140, 10, 14; 361/636; 439/511, 512

See application file for complete search history.

(56) References Cited

U.S. PATENT DOCUMENTS

| | | | | |
|---|---|---|---|---|
| 5,094,626 | A * | 3/1992 | Fabrizi et al. | 439/511 |
| 5,541,561 | A * | 7/1996 | Grunert | H01H 9/42 335/132 |
| 5,669,788 | A * | 9/1997 | Brockman | 439/511 |
| 2004/0217831 | A1* | 11/2004 | Bauer | H01H 11/0031 335/202 |
| 2008/0047179 | A1* | 2/2008 | Puskar | H01H 71/02 40/463 |
| 2009/0257173 | A1* | 10/2009 | Rane et al. | 361/636 |
| 2015/0016084 | A1* | 1/2015 | Hrncir, Jr. | H01H 71/08 361/824 |

FOREIGN PATENT DOCUMENTS

| | | |
|---|---|---|
| CN | 201311872 | 9/2009 |
| EP | 1942514 | 7/2008 |
| EP | 2876660 | 5/2015 |

OTHER PUBLICATIONS

IEC Medium Voltage Vacuum Circuit Breakers 12 kV, 17.5 kV, and 24 kV Product Guide Eaton Corporation Jan. 2011.*

(Continued)

*Primary Examiner* — Truc Nguyen
(74) *Attorney, Agent, or Firm* — Myers Bigel, P.A.

(57) ABSTRACT

A vacuum circuit breaker includes a frame and a vacuum interrupter supported by the frame. A control wiring harness exits from an opening in a top face of a housing portion of the frame and a terminal block is disposed on the top face of the housing portion and includes first terminals connected to wires of the control wiring harness and second terminals configured to be connected to external wires.

20 Claims, 7 Drawing Sheets

(56) References Cited

OTHER PUBLICATIONS

Dietrich Biester: *Siemens 4000 A Vakuum-Leistingsschalter*, Oct. 2009, pp. 1-3; Retrieved from http://www.siemens.com/press/pool/de/pressemitteilungen/2009/power_distribution/ (picture).
European Search Report, corresponding to EP App. No. 14192855.6, 9 pages, Apr. 24, 2015.
*W-VACi for safety, reliability and performance*; IEC Medium Voltage Vacuum Circuit Breakers 12 kV, 17.5 kV and 24 kV Product Guide , Eaton Corporation, Jan. 2011, pp. 1-16.

* cited by examiner

CIRCUIT BREAKER WITH LOW-CLEARANCE CONNECTIONS

BACKGROUND

The inventive subject matter relates to circuit breakers and, more particularly, to connection interfaces for circuit breakers.

Medium voltage vacuum circuit breakers are commonly used in industrial power systems. For example, in mining applications, medium voltage breakers may be used to protect transformers, capacitor banks, motors, busbar sections and cables. Such breakers may be designed to be resistant to dust and moisture and may have a compact form factor that facilitates installation in low-profile mining equipment sleds.

FIG. 1 illustrates a conventional medium voltage vacuum circuit breaker 10. The breaker 10 includes a frame 11 including a housing portion 14 and a shelf portion 12. A plurality of vacuum interrupter poles 16 are mounted on the shelf portion 12. The vacuum interrupter poles 16 are sealed units that contain vacuum interrupters within. The vacuum interrupters are configured to provide switches in line with conductors connected to the poles 16. The housing portion 14 contains a mechanism for actuating the vacuum interrupters. A user interface for the breaker 1 is provided at a front face 15 of the housing portion 14. Electrical connections between external control systems and the breaker actuator mechanism are made via a gooseneck wiring channel and connecter 17 positioned above a top surface 19 of the housing portion 14.

SUMMARY

Some embodiments of the inventive subject matter provide a vacuum circuit breaker including a frame and a vacuum interrupter supported by the frame. A control wiring harness exits from an opening in a top face of a housing portion of the frame and a terminal block is disposed on the top face of the housing portion and includes first terminals connected to wires of the control wiring harness and second terminals configured to be connected to external wires.

In some embodiments, the terminal block includes a feed-through terminal block. The first terminals may have wire entry locations on a first side of the feed-through terminal block and the second terminals may have wire entry locations on a second side of the feed-through terminal block. The circuit breaker may further include a DIN rail affixed to the top face of the housing portion and the feed-through terminal block may include a plurality of modular feed-through terminal blocks mounted on the DIN rail. At least one jumper may electrically interconnect at least one of the first terminals and at least one of the second terminals.

In some embodiments, the terminal block includes a screw terminal block, the first terminals include a first row of screw terminals on a top side of the screw terminal block and the second terminals include a second row of screw terminals parallel to the first row of screw terminals on the top side of the screw terminal block. At least one jumper may electrically interconnect at least one of the first screw terminals and at least one of the second screw terminals. A DIN rail may be affixed to the top face of the housing portion and the terminal block may be mounted on the DIN rail, e.g., using self-clinching studs that engage holes in the DIN rail.

In some embodiments, the terminal block extends less than about 2 inches above the top face of the housing portion. In further embodiments, the terminal block extends less than about 1 inch above the top face of the housing portion.

Some embodiments of the inventive subject matter provide an apparatus including a vacuum circuit breaker having a frame including a housing portion having first side face serving as a front panel of the circuit breaker. A control wiring harness passes through a top face of the housing portion. A DIN rail is mounted on the top face and a terminal block is mounted on the DIN rail, connected to wires of the control wiring harness and configured to be connected to external wiring. In some embodiments, the terminal block may include a plurality of modular terminal blocks mounted on the DIN rail. In other embodiments, the terminal block may include a screw terminal block mounted on the DIN rail using self-clinching studs that engage holes in the DIN rail.

DETAILED DESCRIPTION

Figure 1:
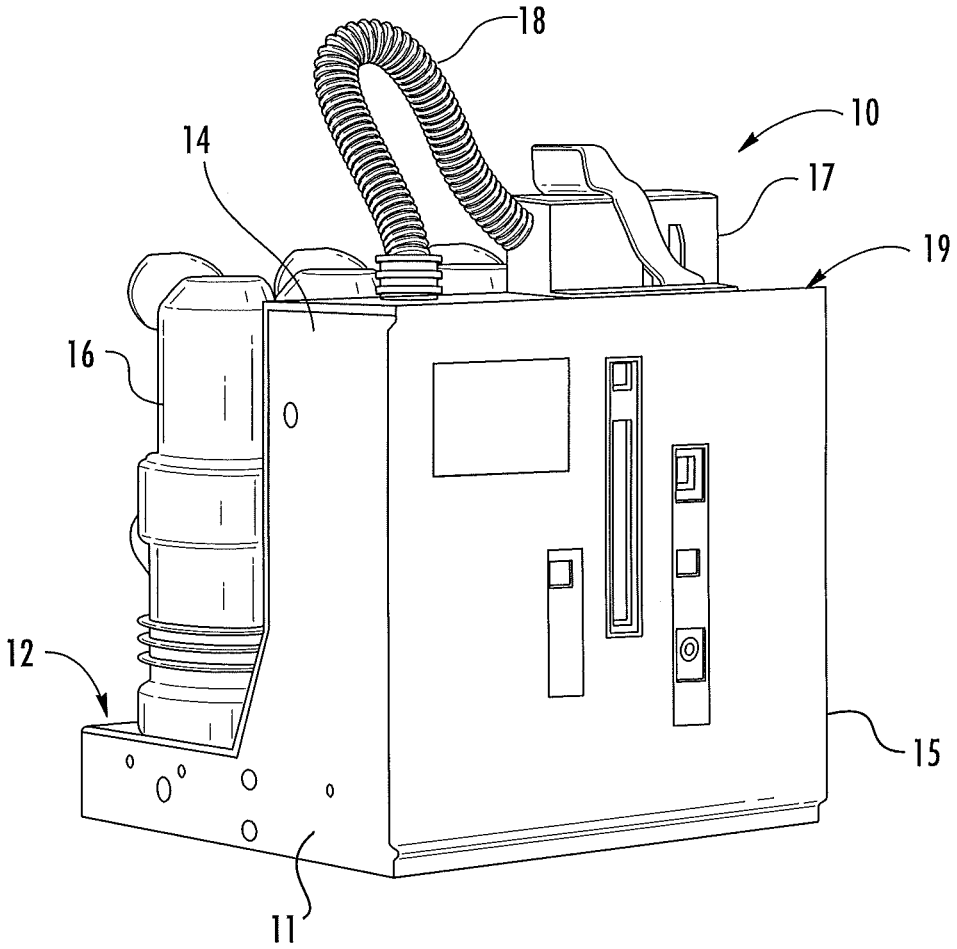
FIG. 1 PRIOR ART
FIG. 1 illustrates a conventional circuit breaker.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Figure 2:
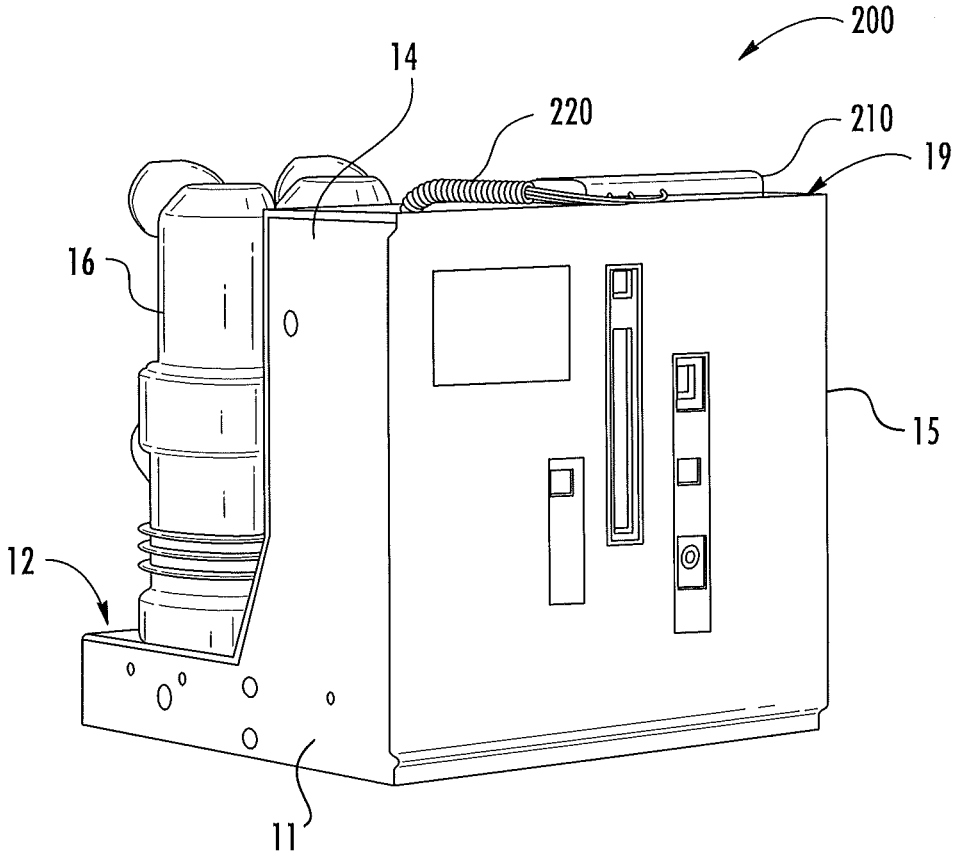
FIGS. 2-4 are perspective, front and top view of a circuit breaker according to some embodiments.
Figure 3:
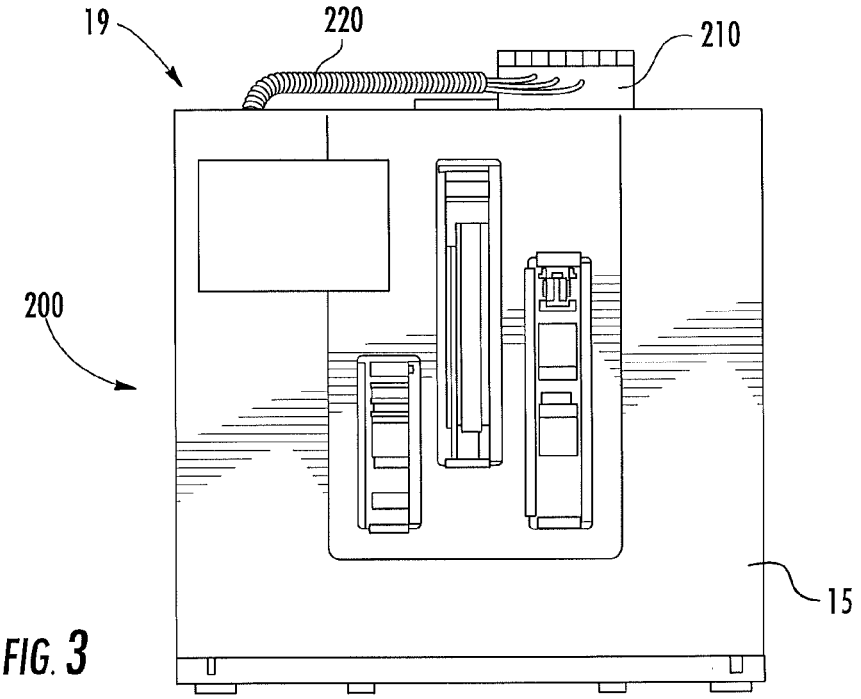
Figure 4:
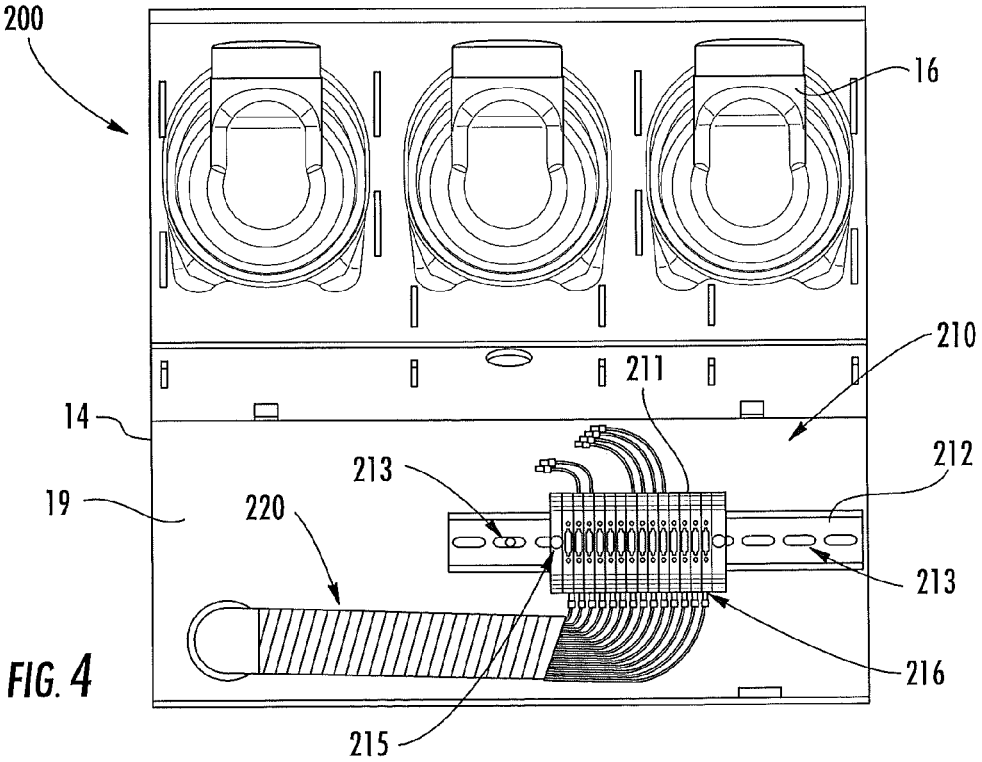

FIGS. 2-4 illustrate a vacuum circuit breaker 200 according to some embodiments of the inventive subject matter. Referring to FIG. 2, the breaker 200 includes a frame 11 including a housing portion 14 and a shelf portion 12. A plurality of vacuum breaker poles 16 are mounted on the shelf portion 12. The housing portion 14 houses a mechanism for actuating vacuum interrupters in the vacuum interrupter poles 16. A user interface is provided at a front face 15 of the housing portion 14. Electrical connections between external control and power systems and the breaker actuator mechanism are made via a wiring harness 220 connected to a terminal block assembly 210 mounted on a top surface 19 of the housing portion 14.

Figure 5:
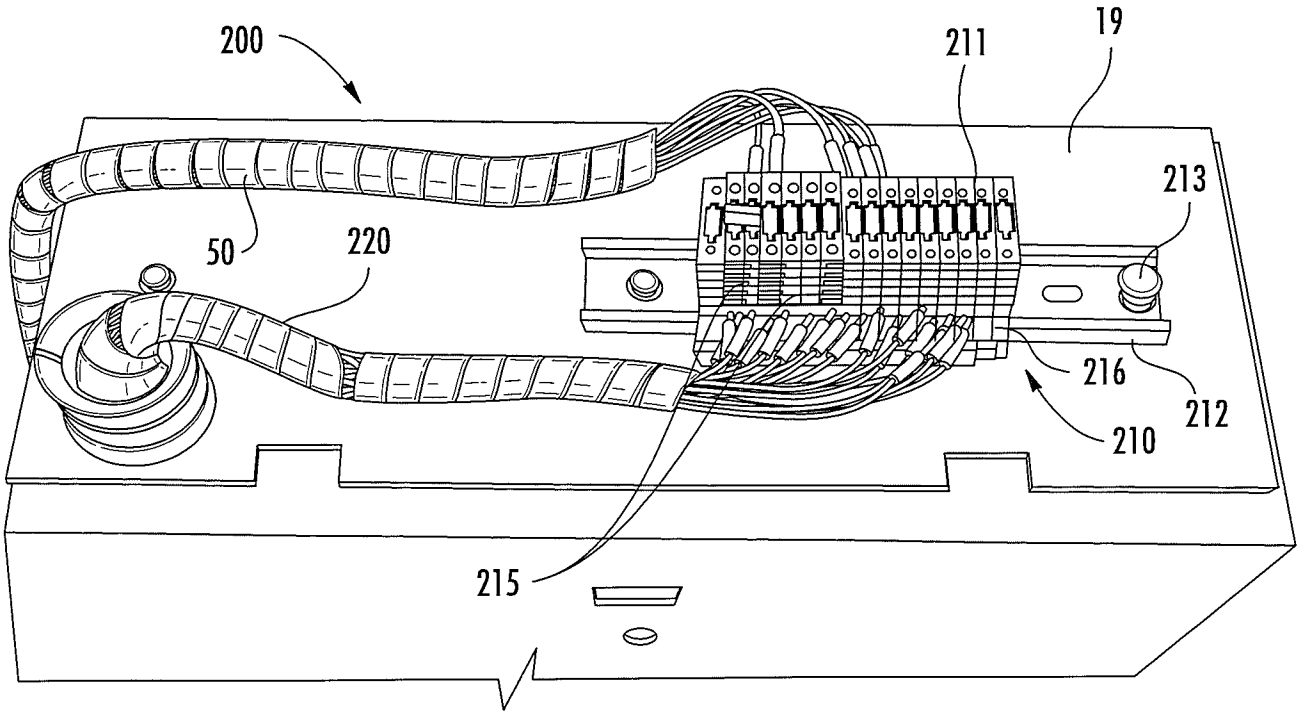
FIG. 5 is a detailed view of connection block of the circuit breaker of FIGS. 2-4.

Referring to FIGS. 4 and 5, the terminal block assembly 210 includes a plurality of modular feed-through terminal blocks 211 mounted on DIN rail 212. The DIN rail 212 may be mounted to a top surface 19 of the housing portion 14 using bolts 213 or other fasteners. The modular feed-through terminal blocks 211 may be configured such that wires from the wiring harness 220 are inserted therein from a first side of the terminal block assembly 210 and external wires 50 are inserted in the terminal blocks 211 from a second side of the terminal block assembly 210. The blocks 211 may include single blocks 216 configured for connection of individual control signal lines and blocks 215 interconnected using jumpers to join multiple conductors for power distribution and other functions, as explained below with reference to FIG. 8. The modular feed-through terminal blocks 211 may include, for example, Allen-Bradley IEC terminal blocks as described at www.ab.com. Use of such feed-through terminal blocks mounted on a DIN rail as described above may limit height of the terminal block to less than about 2 inches above the top surface 19 of the housing portion of the frame 19. The blocks 211 may be color coded for identification.

Figure 6:
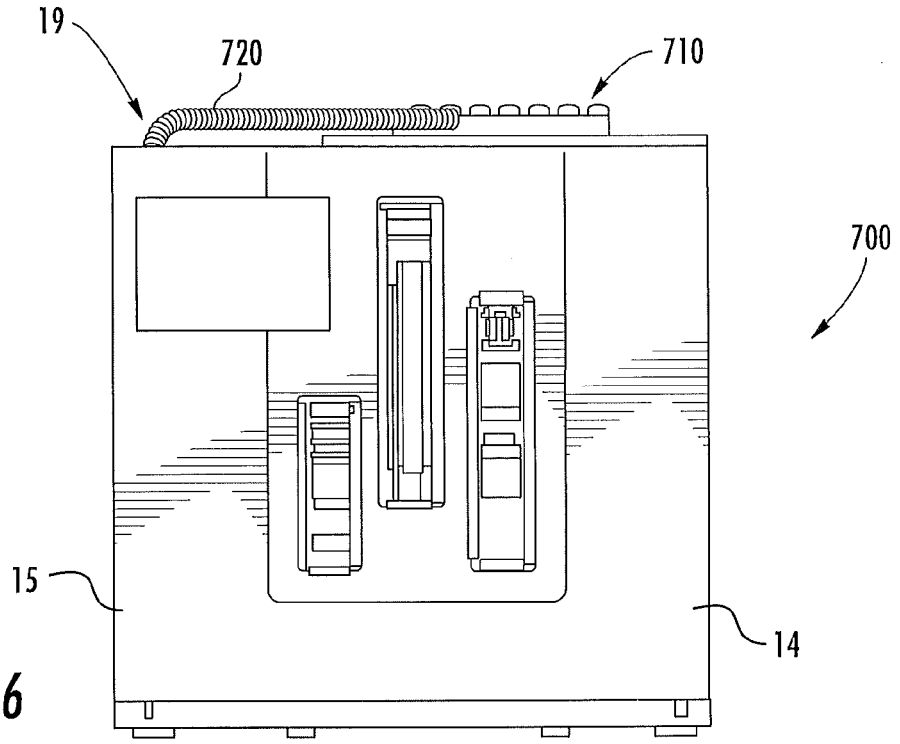
FIGS. 6 and 7 are front and top views, respectively, of a circuit breaker according to further embodiments.
Figure 7:
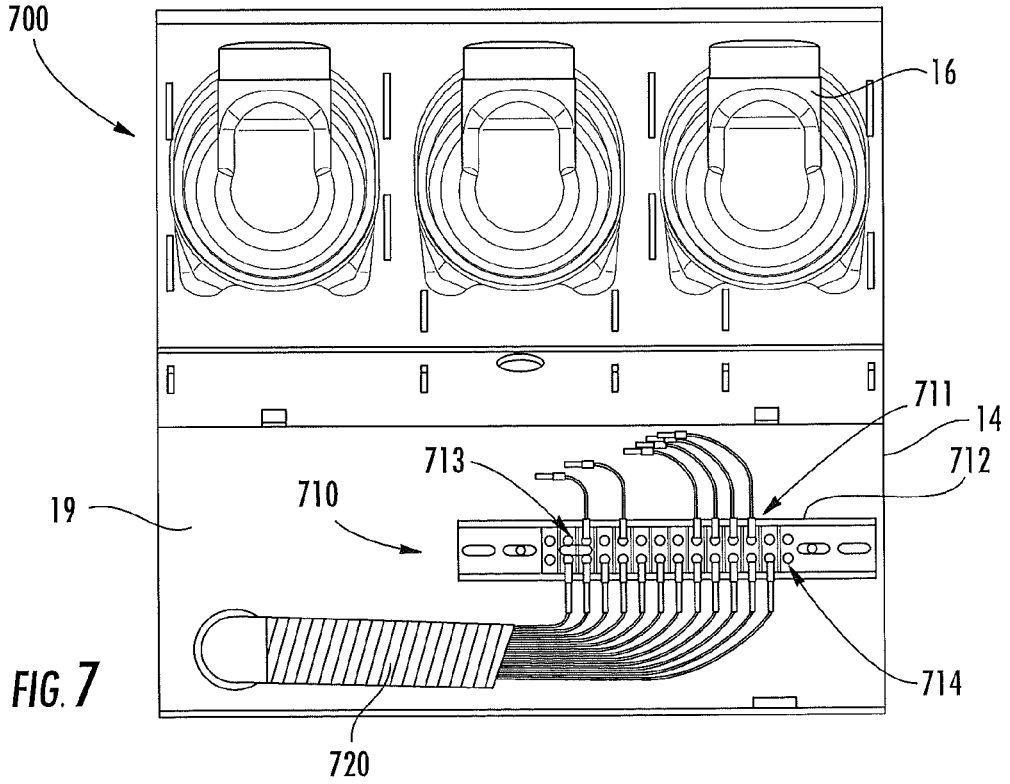

FIGS. 6 and 7 illustrate a vacuum circuit breaker 700 according to further embodiments of the inventive subject matter. Referring to FIG. 7, the breaker 700 includes a frame 11 including a housing portion 14 and a shelf portion 12. A plurality of vacuum interrupter poles 16 are mounted on the shelf portion 12. The housing portion 14 contains a mechanism for actuating vacuum interrupters in the poles 16, and a user interface is provided at a front face 15 of the housing portion 14. Electrical connections between external control and power systems and the breaker actuator mechanism are made via a wiring harness 720 connected to a screw terminal assembly 710 mounted on a top surface 19 of the housing portion 14.

Referring to FIG. 7, the screw terminal assembly 710 comprises a screw terminal block 711 including a plurality of screw terminals 713, with wires from the wiring harness 720 being connected to a first row of terminals and external wires being connected to a second row of terminals. The screw terminal block 711 may be mounted on a DIN rail 712 using self-clinching (e.g., PEM®) studs 714. The DIN rail 712 may be secured to a top surface 19 of the housing portion 14 using bolts, screws or other fasteners. Interconnection of groups of the terminals 713 may be made using jumper plates or other jumpers. The interconnections provided may be similar to those described above with reference the embodiments of FIGS. 2-5.

Figure 8:
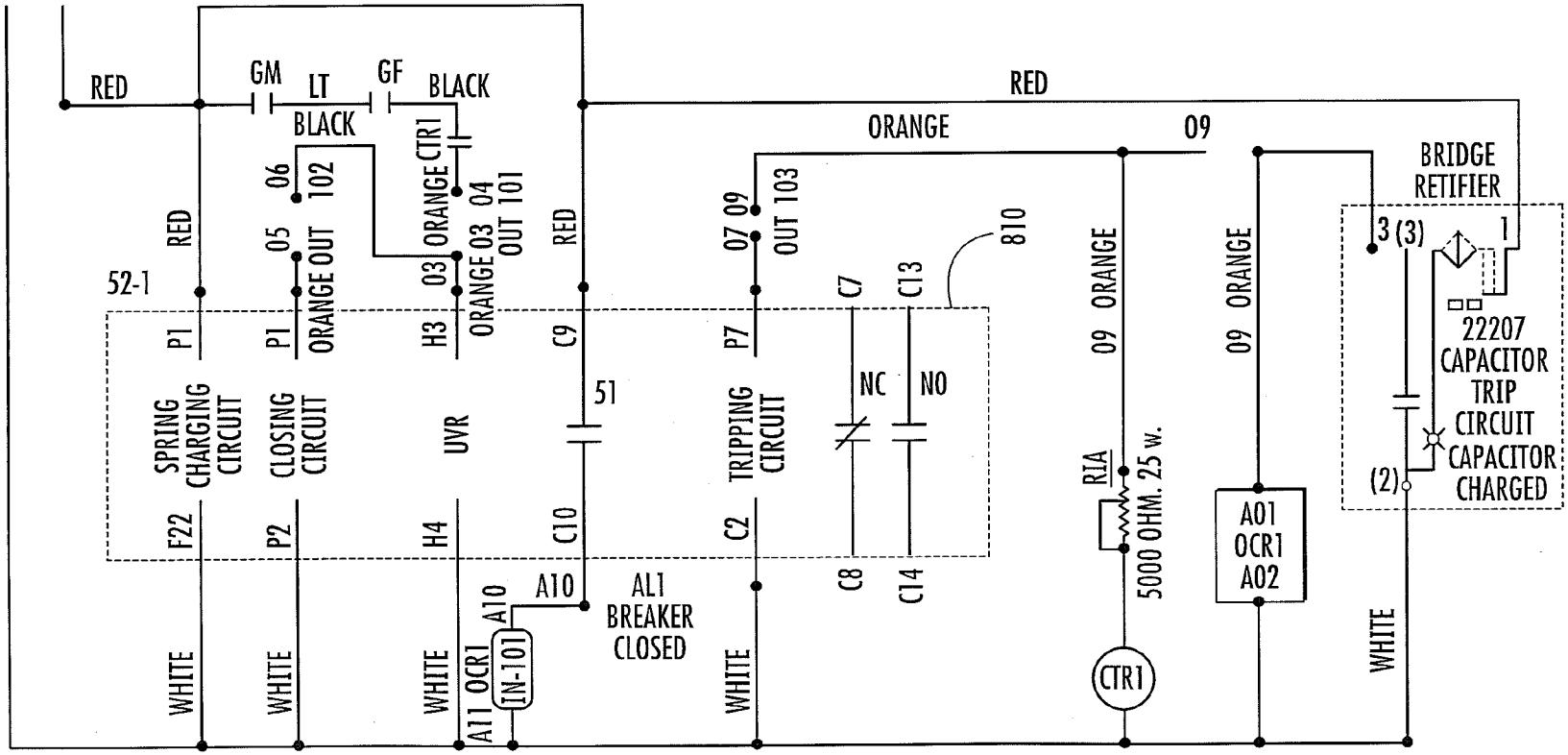
FIG. 8 is a schematic diagram illustration control connections for a circuit breaker according to some embodiments.

FIG. 8 illustrates a field wiring diagram for the breakers 200 and 700 of FIGS. 2-7. A terminal block 810 includes terminals P1, H3, C9, P7, C7, C13, F22, P2, H4, C10, C2 C8 and C14. Jumpering of terminals P1, C9 coupled to a red power line and jumpering of terminals F22, P2, H4, C2 coupled to a white power line provides a parallel connection of a shunt tripping coil, a spring charging motor and a closing coil of the breaker 200, 700. These devices are coupled to an under voltage release (UVR) relay. Consequently, if any of these devices burns up, a voltage across a coil of the UVR relay will decrease as the resistance across the failed device increases, causing the UVR relay to open and trip the breaker 200, 700. Thus, a "failsafe" failure mode may be provided.

Figure 9:
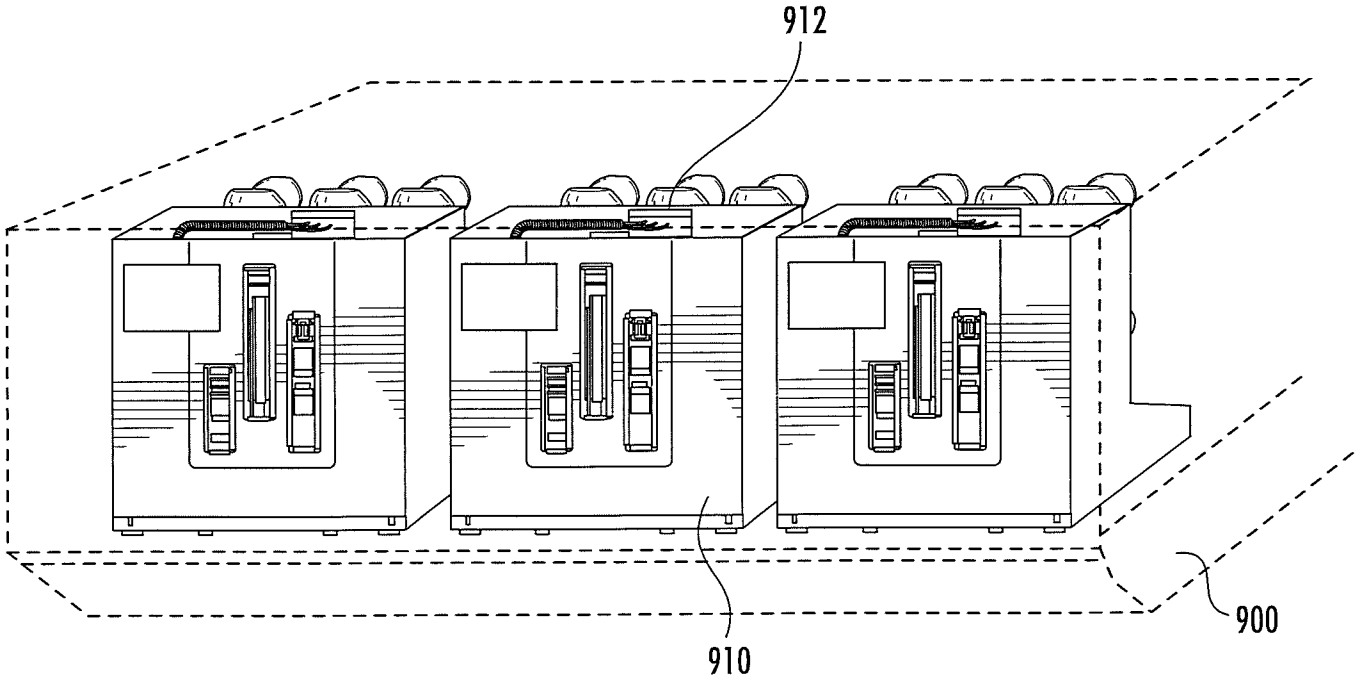
FIG. 9 is a perspective view of circuit breakers according to some embodiments installed in a mining equipment sled.

FIG. 9 illustrates an exemplary application of circuit breakers according to some embodiments. Circuit breakers 910 along the lines described above with reference to FIGS. 2-8 may be installed in a mining equipment sled 900 that may be used for power distribution in a mine. Low-clearance terminal structures 912 of the circuit breakers 910 may be use modular feed-through or screw terminal blocks as described above, which may facilitate installation in the low-slung sled 900. The simplification of connections provided by the terminal structures 912 may also simplify customer wiring.

In the drawings and specification, there have been disclosed exemplary embodiments of the inventive subject matter. Although specific terms are employed, they are used in a generic and descriptive sense only and not for purposes of limitation, the scope of the inventive subject matter being defined by the following claims.

That which is claimed:

1. A vacuum circuit breaker comprising:

a frame;

a vacuum interrupter supported by the frame;

a control wiring harness exiting from an opening in a top face of a housing portion of the frame; and a terminal block disposed on the top face of the housing portion and comprising first terminals connected to wires of the control wiring harness and second terminals configured to be connected to external wires; and wherein a plurality of the first terminals are jumpered together and a plurality of the second terminals are jumpered together to thereby support a failsafe failure mode of operation by providing a parallel connection of a shunt tripping coil, a spring charging motor and a closing coil of the vacuum circuit breaker.

2. The vacuum circuit breaker of claim 1, wherein the terminal block comprises a feed-through terminal block, wherein the first terminals have wire entry locations on a first side face of the feed-through terminal block and wherein the second terminals have wire entry locations on a second side face of the feed-through terminal block.

3. The vacuum circuit breaker of claim 2, further comprising a DIN rail affixed to the top face of the housing portion and wherein the first and second terminals comprise terminals of a plurality of modular feed-through terminal blocks mounted on the DIN rail.

4. The vacuum circuit breaker of claim 3, further comprising at least one jumper electrically interconnecting at least one of the first terminals and at least one of the second terminals.

5. The vacuum circuit breaker of claim 1, wherein the terminal block comprises screw terminal block, wherein the first terminals comprise a first row of screw terminals on a top side of the screw terminal block and wherein the second terminals comprise a second row of screw terminals parallel to the first row of screw terminals on the top side of the screw terminal block.

6. The vacuum circuit breaker of claim 5, further comprising at least one jumper electrically interconnecting at least one of the first screw terminals and at least one of the second screw terminals.

7. The vacuum circuit breaker of claim 5, further comprising a DIN rail affixed to the top face of the housing portion and wherein the terminal block is mounted on the DIN rail.

8. The vacuum circuit breaker of claim 7, wherein the terminal block is mounted to the DIN rail using self-clinching studs.

9. The vacuum circuit breaker of claim 1, wherein the terminal block extends less than about 2 inches above the top face of the housing portion.

10. The vacuum circuit breaker of claim 9, wherein the terminal block extends less than about 1 inch above the top face of the housing portion.

11. The vacuum circuit breaker of claim 1, further comprising at least one jumper electrically interconnecting at least two of the first terminals to at least two of the second terminals.

12. The vacuum circuit breaker of claim 11, wherein the at least one jumper is configured to allow a lesser number of wires to be connected to the second terminals than a number of wires connected to the first terminals.

13. The vacuum circuit breaker of claim 1, further comprising an under voltage release (UVR) relay electrically coupled to the shunt tripping coil, the spring charging motor and the closing coil; and wherein a voltage across a coil of the UVR relay decreases in response to an increase in resistance across any one of the shunt tripping coil, the spring charging motor and the closing coil.

14. An apparatus comprising:

a vacuum circuit breaker having a frame comprising a housing portion having first side face serving as a front panel of the circuit breaker;

a control wiring harness passing through a top face of the housing portion;

a DIN rail mounted on the top face; and a terminal block mounted on the DIN rail, connected to wires of the control wiring harness and configured to be connected to external wiring; and wherein a plurality of first terminals on a first side of said terminal block are jumpered together and a plurality of second terminals on a second side of said terminal block are jumpered together to thereby support a fail-safe failure mode of operation by providing a parallel connection of a shunt tripping coil, a spring charging motor and a closing coil of said vacuum circuit breaker.

15. The apparatus of claim 14, wherein the terminal block comprises a plurality of modular terminal blocks mounted on the DIN rail.

16. The apparatus of claim 14, wherein the terminal block comprises a screw terminal block mounted on the DIN rail using self-clinching studs.

17. The apparatus of claim 14, wherein the terminal block extends less than about 2 inches above the top face of the housing.

18. The apparatus of claim 14, wherein the terminal block extends less than about 1 inch above the top face of the housing.

19. The apparatus of claim 14, further comprising at least one jumper electrically interconnecting at least two terminals of the terminal block to allow a lesser number of the external wires to be connected to the terminal block than a number of wires of the control wiring harness connected to the terminal block.

20. The apparatus of claim 19, further comprising a UVR relay electrically coupled to the shunt tripping coil, the spring charging motor and the closing coil; and wherein a voltage across a coil of the UVR relay decreases in response to an increase in resistance across any one of the shunt tripping coil, the spring charging motor and the closing coil.

* * * * *